US010193273B2

(12) United States Patent
Denz

(10) Patent No.: US 10,193,273 B2
(45) Date of Patent: Jan. 29, 2019

(54) PLUG-IN CONNECTION HAVING A LOCKING ELEMENT

(71) Applicant: Hirschmann Automotive GmbH, Rankweil/Brederis (AT)

(72) Inventor: Alexander Denz, Feldkirch (AT)

(73) Assignee: HIRSCHMANN AUTOMOTIVE GMBH, Rankweil/Brederis (AT)

( * ) Notice: Subject to any disclaimer, the term of this patent is extended or adjusted under 35 U.S.C. 154(b) by 0 days.

(21) Appl. No.: 15/523,859

(22) PCT Filed: Dec. 3, 2015

(86) PCT No.: PCT/EP2015/078504

§ 371 (c)(1),
(2) Date: May 12, 2017

(87) PCT Pub. No.: WO2016/087579

PCT Pub. Date: Jun. 9, 2016

(65) Prior Publication Data

US 2017/0373435 A1 Dec. 28, 2017

(30) Foreign Application Priority Data

Dec. 3, 2014 (DE) ..... 10 2014 117 760

(51) Int. Cl.
*H01R 13/627* (2006.01)

(52) U.S. Cl.
CPC ..... *H01R 13/6272* (2013.01); *H01R 13/6278* (2013.01)

(58) Field of Classification Search
CPC ..... H01R 2103/00; H01R 13/5219; H01R 13/50; H01R 13/4362
(Continued)

(56) References Cited

U.S. PATENT DOCUMENTS 5,137,466 A * 8/1992 Endo ..... H01R 13/627 439/353
5,711,684 A * 1/1998 Inoue ..... H01R 13/6272 439/354

(Continued)

FOREIGN PATENT DOCUMENTS

DE 102007026582 B 12/2008
EP 1513225 A 3/2005

(Continued)

*Primary Examiner* — Abdullah Riyami
*Assistant Examiner* — Nelson R Burgos-Guntin
(74) *Attorney, Agent, or Firm* — Andrew Wilford

(57) ABSTRACT

The invention relates to a plug-in connection, comprising a plug connector having a plug connector housing (1) and comprising a mating plug connector that can be plugged together with the plug connector, wherein the plug connector has a superstructure (4) and the superstructure (4) accommodates a locking element (8) in a preliminary latching position and a final latching position, wherein the plug connector has first latching means and the locking element (8) has first latching means corresponding thereto and the mating plug connector has further latching means and the locking element (8) has further latching means corresponding thereto, wherein the locking element (8) is first fastened to the plug connector in the preliminary latching position by means of the first latching means corresponding to each other before the mating plug connector is inserted into the plug connector, and the further latching means corresponding to each other are actuated by means of the insertion of the mating plug connector into the plug connector, whereby the locking element (8) can be moved into the final latching position thereof, characterized in that the plug connector housing (1) and the locking element (8) have third latching means corresponding to each other, by means of which additional locking of the locking element (8) to the plug
(Continued)

connector occurs when the locking element has been moved into the final latching position thereof.

6 Claims, 6 Drawing Sheets

(58) Field of Classification Search
USPC ..... 439/752, 357, 358, 352
See application file for complete search history.

(56) References Cited

U.S. PATENT DOCUMENTS

| | | | | |
|---|---|---|---|---|
| 5,830,013 | A * | 11/1998 | Saito | H01R 13/4362 439/595 |
| 6,126,480 | A * | 10/2000 | Kawase | H01R 13/6272 439/352 |
| 6,354,860 | B1 * | 3/2002 | Miller | H01R 13/6272 439/352 |
| 6,533,600 | B1 * | 3/2003 | Kashiyama | H01R 13/641 439/352 |
| 6,537,108 | B2 * | 3/2003 | Sasaki | H01R 13/4364 439/595 |
| 6,860,750 | B1 * | 3/2005 | Wu | H01R 13/6275 439/357 |
| 7,399,195 | B2 * | 7/2008 | Kim | H01R 13/641 439/352 |
| 7,549,887 | B1 * | 6/2009 | Ng | H01R 13/6272 439/352 |
| 7,909,638 | B2 * | 3/2011 | Seo | H01R 13/6272 439/352 |
| 7,988,482 | B2 * | 8/2011 | Kim | H01R 13/6599 439/357 |
| 7,988,502 | B2 * | 8/2011 | Nagano | H01R 13/424 439/595 |
| 8,038,486 | B1 * | 10/2011 | Nakamura | H01R 13/4362 439/752 |
| 8,337,235 | B2 * | 12/2012 | Mizutani | H01R 13/6272 439/352 |
| 9,017,111 | B2 * | 4/2015 | Zheng | H01R 13/4223 439/595 |
| 2001/0046803 | A1 * | 11/2001 | Kodama | H01R 13/6273 439/357 |
| 2005/0227548 | A1 * | 10/2005 | Sian | H01R 13/424 439/752 |
| 2007/0224888 | A1 * | 9/2007 | Tyler | H01R 13/4365 439/752 |
| 2008/0305672 | A1 * | 12/2008 | Kodama | H01R 13/6273 439/357 |
| 2009/0149054 | A1 * | 6/2009 | Zheng | H01R 13/6272 439/357 |
| 2010/0068911 | A1 * | 3/2010 | Nagano | H01R 13/424 439/345 |
| 2011/0244706 | A1 * | 10/2011 | Rohde | H01R 13/6272 439/357 |
| 2014/0179146 | A1 * | 6/2014 | Hamai | H01R 13/6272 439/357 |
| 2015/0349449 | A1 * | 12/2015 | Zhu | H01R 13/4368 439/752 |
| 2017/0025780 | A1 * | 1/2017 | Kida | H01R 13/4362 |

FOREIGN PATENT DOCUMENTS

| | | |
|---|---|---|
| EP | 2200127 A | 6/2010 |
| EP | 2587595 A | 5/2013 |

* cited by examiner

PLUG-IN CONNECTION HAVING A LOCKING ELEMENT

CROSS REFERENCE TO RELATED APPLICATIONS

This application is the US-national stage of PCT application PCT/EP2015/078504 filed 3 Dec. 2015 and claiming the priority of German patent application 102014117760.6 itself filed 3 Dec. 2014.

FIELD OF THE INVENTION

The invention relates to a connector assembly comprising a plug connector having a plug connector housing and a mating plug connector that can be plugged together with the plug connector that has a superstructure that in turn has a locking element in a partially latched position and a fully latched position wherein the plug connector has first latch formations and the locking element has first latch formations complementary to the former and the mating plug connector has second latch formations and the locking element has second latch formations complementary to the former, wherein the locking element is first fastened to the plug connector in the partially latched position by means of the first latch formations complementary to one another, before the mating plug connector is inserted into the plug connector, and the second latch formations that are complementary to one another are actuated by the insertion of the mating plug connector into the plug connector so that the locking element can be moved into its fully latched position.

BACKGROUND OF THE INVENTION

Connector assemblies having a plug connector and a mating plug connector that can be connected to it are known, in particular for automated applications. Because of the rough use conditions to which such connector assembly are subjected, it is necessary for the plug connector and the mating plug connector to be latched onto one another. Furthermore, it is necessary to provide haptic and/or optical feedback during the assembly process to the person joining the plug connector and the mating plug connector to reveal whether the connector assembly has been plugged together correctly. For this reason locking elements (CPA=connector position assurance) have become known. Known locking elements have first latch formations that worked together with complementary latch formations on the plug connector. Because of these first latch formations that work together, the locking element can be secured in a partially latched position on the plug connector, more precisely on its plug connector housing. This first ensures that the plug connector together with the locking element is prepared for further assembly, namely the process of being plugged together with the mating plug connector, without the possibility of losing the locking element. The locking element can be moved out of its partially latched position only into its fully latched position but not into any other position (for example away from the plug connector). When the mating plug connector has been inserted into the plug connector, its latch formations ensure that second latch formations of the locking element complementary thereto are activated. These second latch formations allow the locking element to be moved from its partially latched position that it has already assumed and into its fully latched position only when the mating plug connector is in the proper position and has been inserted completely into the plug connector. Only then do the second latch formations on the locking element and the mating plug connector allow the locking element to be moved into its fully latched position. This is usually a straight-line displacement.

This type of movement of the locking element out of its partially latched position and into its fully latched position has basically proven successful but it still has disadvantages. First, the latch formations, in particular the second latch formations on the locking element and on the mating plug connector are designed so that areas of the locking element, when it has assumed its fully latched position, are under stress. In other words the locking element is under pressure during the life of the connector assembly, so that rough ambient conditions such as temperature fluctuations, vibrations and the like can result in material fatigue, which may even lead to breakage or failure. However, this has the negative effect that the mating plug connector can then slip out of the plug connector that thus open circuits the connector assembly. This can in turn result in failure of functions but also safety risks, in particular in vehicles.

Furthermore, there is the disadvantage that because of the design size of the connector assembly, the displacement paths from the partially latched position into the fully latched position are relatively small (in particular less than 10 mm), so that in assembly of the connector assembly (plugging the mating plug connector into the plug connector) and the subsequent activation of the locking element, there is no adequate reliable haptic and/or optical feedback for the assembly person.

OBJECTS OF THE INVENTION

The object of the present invention is therefore to improve upon a connector assembly having a latching element to the extent that the disadvantages described in the introduction are avoided. In particular this should ensure that during assembly of the connector assembly (plugging the plug connector and the mating plug connector together) on subsequent activation of the locking element, a sufficient haptic feedback and/or optical feedback is/are provided and no damage occurs in particular damage to the locking element during the lifetime of the connector assembly.

SUMMARY OF THE INVENTION

This object is according to the invention in that the plug connector housing and the locking element have third latch formations complementary to one another with which a third locking of the locking element on the plug connector is accomplished when it is moved into its fully latched position. Due to the third latch formations such as a latching nose for example on the locking element that engages in a complementary recess on the plug connector housing and/or its superstructure when the locking element has been moved into its fully latched position, it is possible to provide either third optical and/or haptic feedback indicating not only that the locking element has assumed its fully latched position but also that the mating plug connector has been inserted into the plug connector completely and in the correct position. In addition, these third latch formations on the locking element and on the plug connector achieve a third locking so that the connector assembly is thereby held together permanently. The design whereby the locking element is held without stress in its fully latched position on the plug connector housing is particularly advantageous. This is achieved by the fact that no forces are acting on the locking element in its fully latched position so that it is supported in a stress-free state in its fully latched position. Only the complementary latch formations on the locking element that cooperate with the latch formations on the plug connector and the mating plug connector produce the fastening effect. Once all of this has been accomplished and the locking element has arrived in its fully latched position, the locking element is held in a stress-free position on the connector assembly so that material fatigue due to external influences during the lifetime of the connector assembly is effectively avoided.

BRIEF DESCRIPTION OF THE DRAWING

These embodiments and the resulting advantages will now be explained in greater detail with reference to the figures in conjunction with the following description of the figures in which.

SPECIFIC DESCRIPTION OF THE INVENTION

Figure 1:
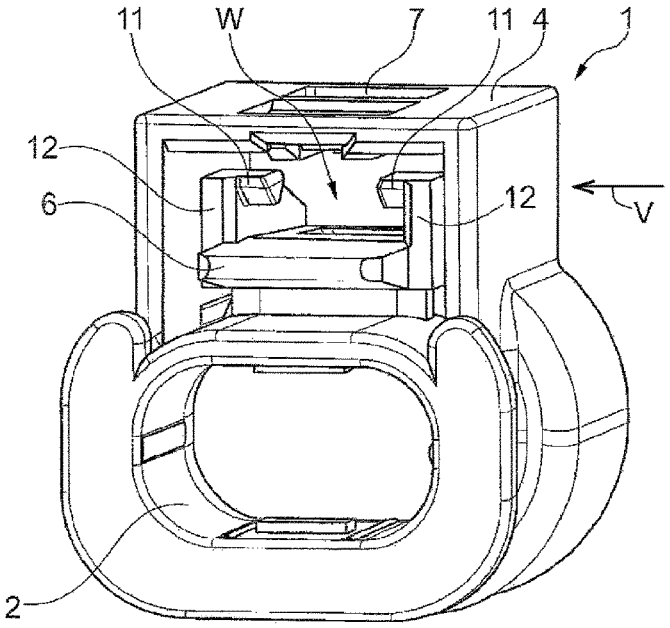
FIG. 1 is a front perspective view of the plug-type connector assembly of this invention.

FIGS. 1 through 14 show an embodiment of a connector assembly having a plug connector and a mating plug connector that can be plugged into the former. Any design of the electric contacts (for example, the type of design of the contact, single-row, double-row, multi-pole or single-pole and the like) is possible but this is irrelevant for an understanding of the invention.

The plug connector housing 1 has a receiving space 2 for an unillustrated contact holder that can be inserted into this receiving space 2 and has contact chambers for a contact partner. A mating plug connector (not shown in greater detail) can be inserted into a receiving space 3 on a side of the plug connector housing 1 facing away from the receiving space 2.

The plug connector housing 1 (also referred to as a protective collar) has a superstructure 4 holding an actuating element that cooperates with the locking element and is described below with its rear part 5 and its front part 6. The superstructure 4 has a recess 7 at its surface. The recess 7 will be described in conjunction with the locking element and its functioning.

Figure 2:
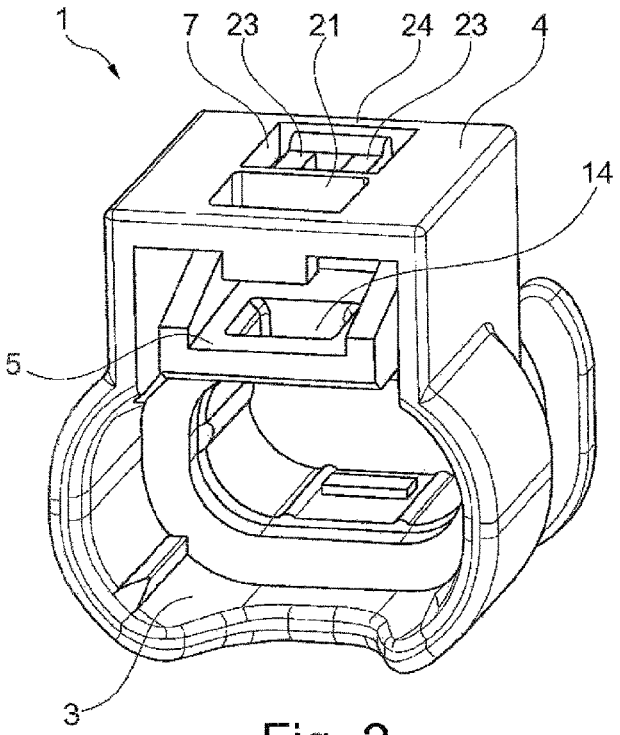
FIG. 2 is a rear perspective of the inventive connector assembly.
Figure 3:
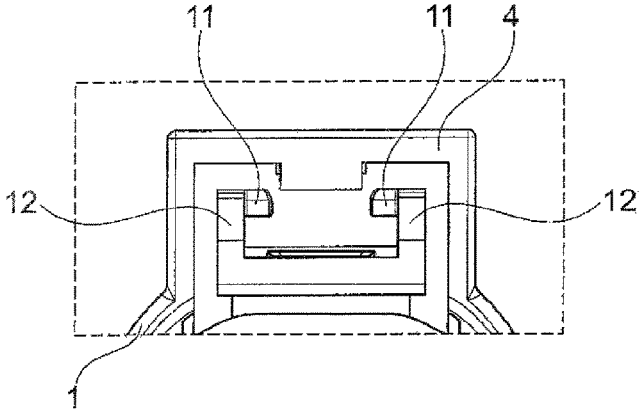
FIG. 3 is a front end view of a detail of the connector assembly.
Figure 4:
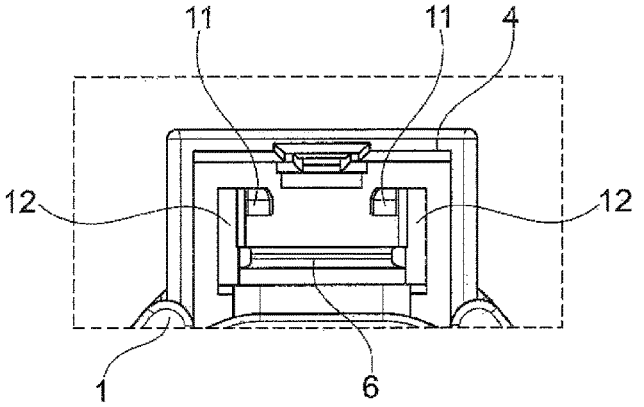
FIG. 4 is a rear end view of a detail of the connector
Figure 5:
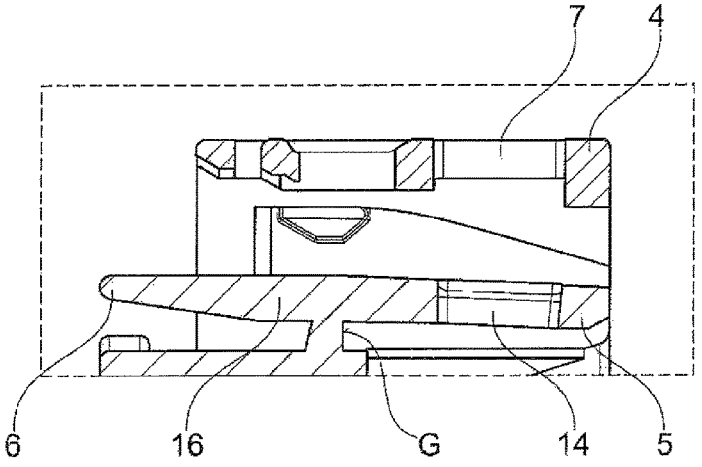
FIG. 5 is a right-side elevational view of the connector assembly taken in the direction of arrow V of FIG. 1.
Figure 6:
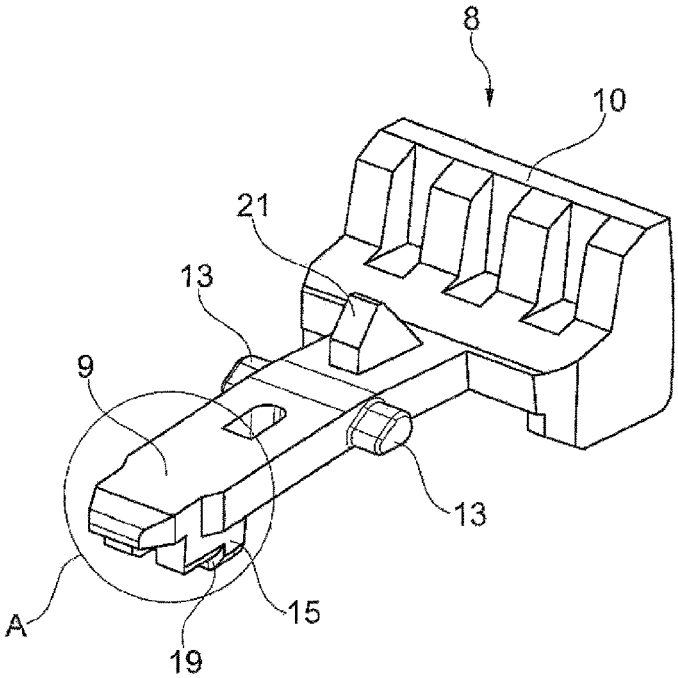
FIG. 6 is a perspective view from above and the front of the locking element of this invention.
Figure 7:
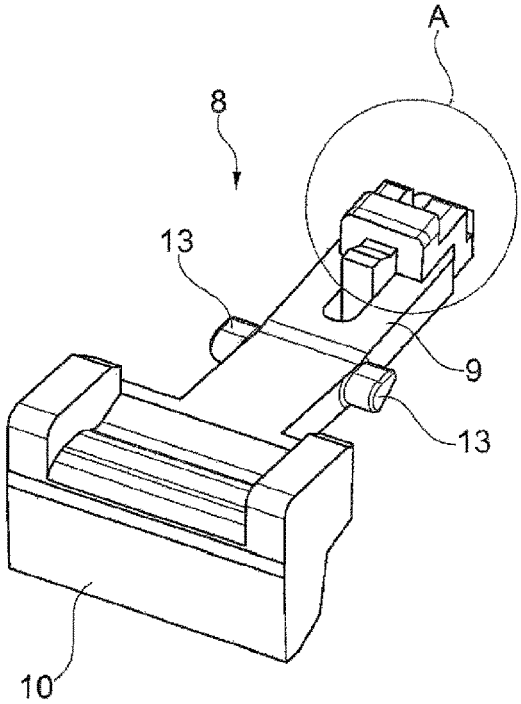
FIG. 7 is a perspective view from below and the rear of the locking element.
Figure 8:
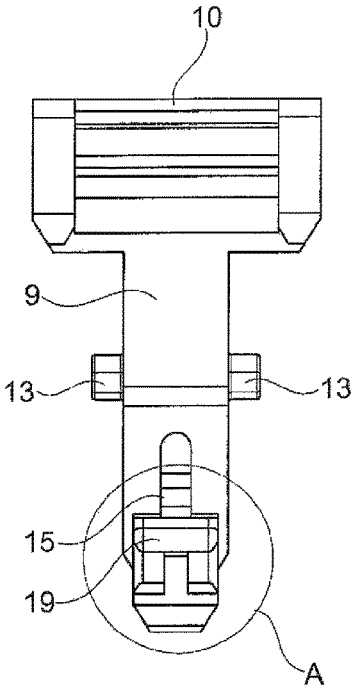
FIG. 8 is a bottom view of the locking element.
Figure 9:
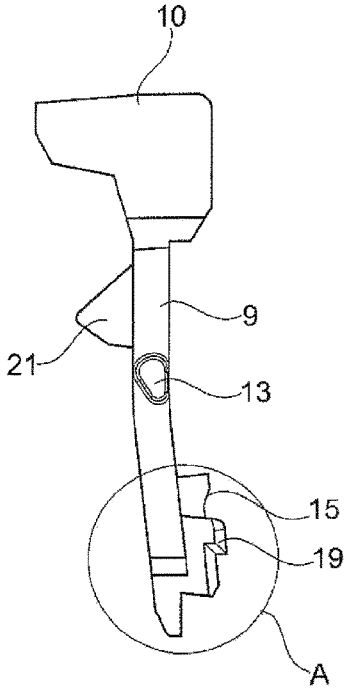
FIG. 9 is a side view of the locking element.
Figure 10:
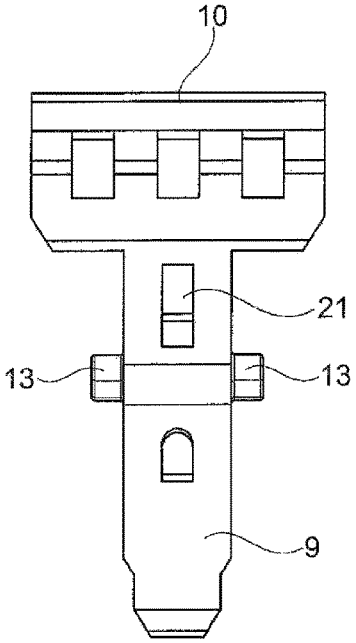
FIG. 10 is a top view of the locking element.

The same reference numerals already used are also used in FIGS. 3 to 5. The reference numerals in FIGS. 1 through 5 will be discussed in greater detail below.

The locking element 8 has essentially a cantilevered arm 9, in particular an elongated cantilevered arm provided on a free end with an actuating part 10. Latch formations for securing the locking element 8 on the plug connector housing 1 are initially indicated in general with A.

The locking element 8 with the front end of the cantilevered arm 9 carrying the latch formations A is inserted into a receiving space W (FIG. 1) and inserted in the direction of the rear part 5, starting from the front part 6. The area between the two parts 5, 6 has a projection 11 on at least one side, but preferably on both sides, as illustrated here, these projections being disposed on a flank, e.g., on parallel flanks 12 as shown here. These flanks 12 are situated approximately between the rear part 5 and the front part 6 of the actuating element that is yet to be described. The projections 11 in interaction with the parallel flanks 12 cause journal pins 13 that are preferably disposed similarly at the side on the cantilevered arm 9 of the locking element 8 to guide the locking element 8 until the latch formations A are inserted into a recess 14 in the area of rear part 5 (FIG. 2). This causes the locking element 8 to be secured in its partially latched position on the plug connector housing 1 by means of these complementary latch formations (recess 14 on the plug connector housing 1 and latch formations A on the locking element 8). Thus the locking element 8 is secured in a loss-proof manner on the plug connector housing 1 and only then can it be moved linearly into its fully latched position when the mating plug connecting has been inserted into the plug connector, more specifically the plug connector housing 1. The partially latched position of the locking element 8 is shown first in FIG. 11 where it can be seen that a projection 15 of the latch formations A (see FIG. 6) has come to rest on a side surface of the recess 14 (see FIG. 2). Furthermore, with a view to the two sections according to FIGS. 11 and 12 it can be seen that the journal pins 13 of the locking element 8 are pressed from behind by the projections 11 on the plug connector housing 1, so that this prevents the cantilevered arm 9 from being able to move out of the recess 14 again with its front region where the latch formations A are situated. If this should be necessary, the front end of the cantilevered arm 9 would have to be raised up by applying a force with a tool so that the latch formations A can be moved out of the recess 14 and the locking element 8 can be reliably removed from its partially latched position.

Figure 11:
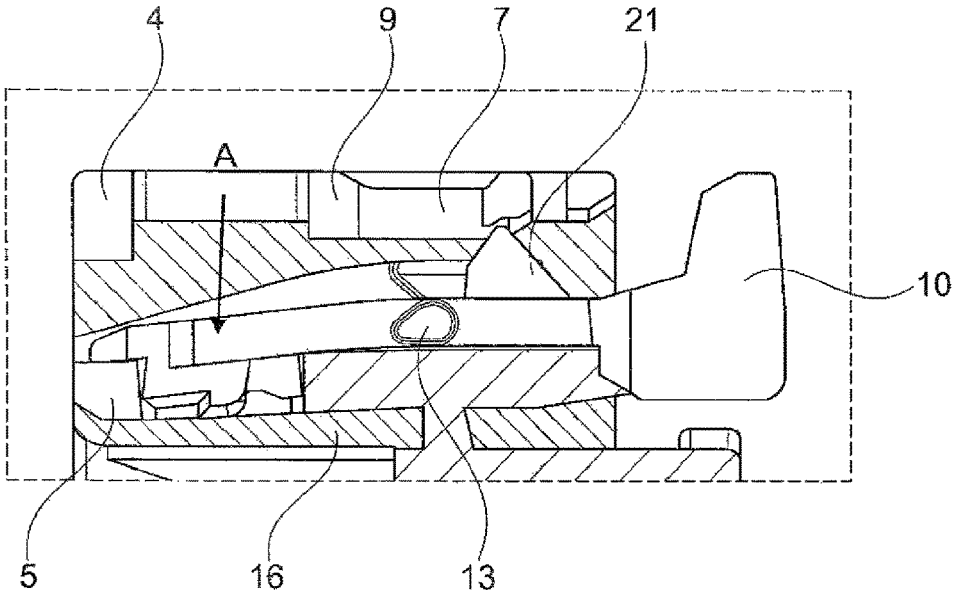
FIGS. 11 and 12 are sections showing the detail of FIG. 5 and the locking element of FIGS. 6-9 in a partially locked position.
Figure 12:
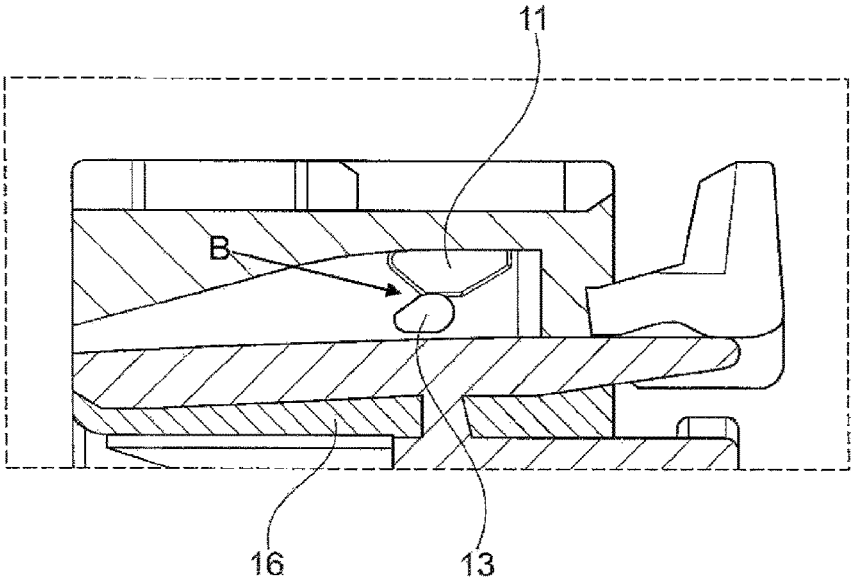
Figure 13:
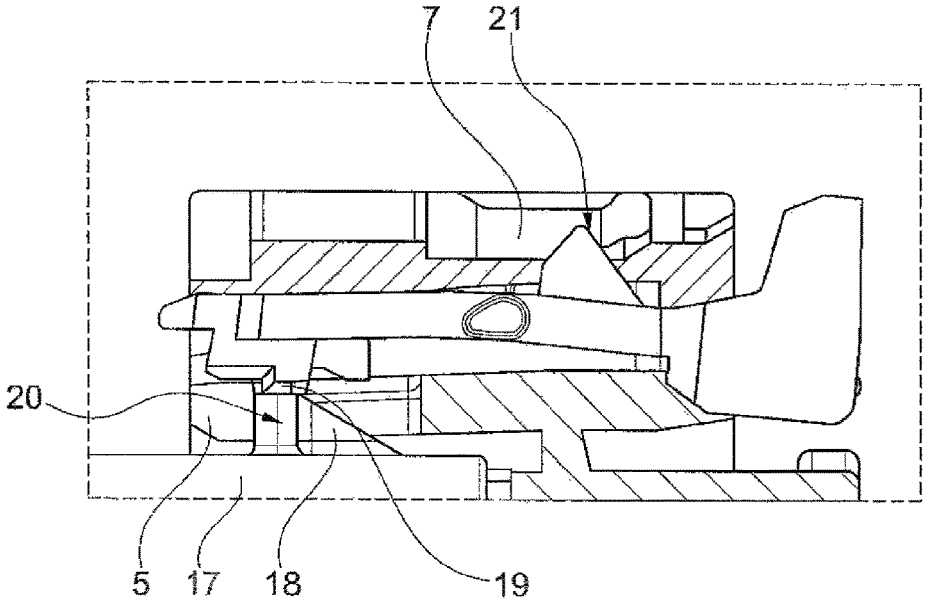
FIGS. 13 and 14 are sections like FIGS. 11 and 12 of the locking element in the fully locked position.
Figure 14:
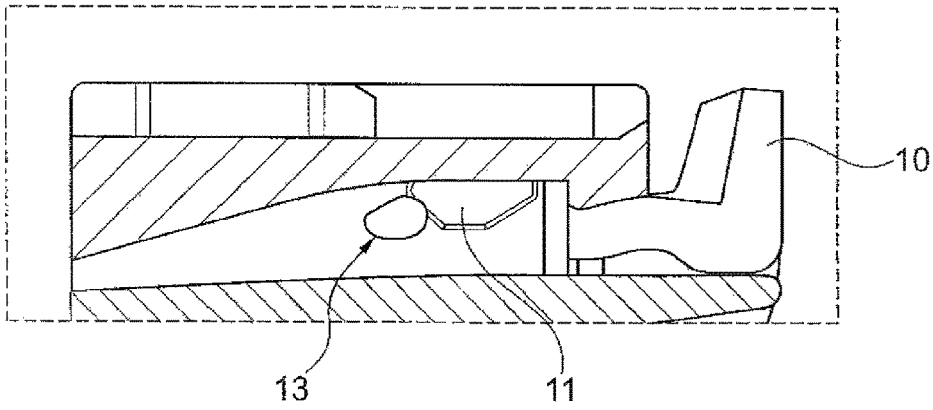

FIG. 11 shows that a connecting part 16 that is designed as a type of joint G (or rocker arm) is situated between the rear part 5 and the front part 6 (see FIG. 5). This is necessary so that the rear part 5 is designed to be movable when the mating plug connector is inserted into the plug connector. Reference is made to FIG. 13 in this regard. It can be seen here that a mating plug connector 17 with its housing, which is not identified further, is inserted into the receiving space 3 on the second latch formations, in particular a latching nose 18. This latching nose 18 that is illustrated here and is embodied in a truncated version initially causes the rear part 5 together with the cantilevered arm 9 and the latch formations A that are still situated in the recess 14 to be raised slightly (upward as shown in FIG. 3), wherein whenever a projection 19 of the latch formations A of the cantilevered arm 9 has been raised above the ramp-type latch formations of the mating plug connector, in particular the beveled latching nose 18, another projection 20 on the mating plug connector can be inserted into the recess 14 (between the rear part 5 and the joint G of the connecting part 16). This projection 20 on the mating plug connector 17 together with the recess 14 forms the second latch formations on the locking element 9 and the mating plug connector 17 that are complementary to one another. As a result of this complementary construction the projection 20 on the mating plug connector 17 can raise the projection 19 on the locking element 9 to the extent that it is no longer inserted into the recess 14. This preparatory movement is not illustrated in the figures but it takes place in the partially latched position of the locking element 9, as illustrated in FIG. 11, in which the locking element 9 is in its partially latched position. Since the projections 13 come to rest on the projections 11 in this position, the front part of the locking element 8 is under a prestress that is eliminated when the locking element 8 has been moved out of the partially latched position illustrated in FIGS. 11 and 12 and into the fully latched position illustrated in FIGS. 13 and 14.

This movement takes place due to pressure on the actuating part 10 of the locking element 8 that can now move a distance farther to the left according to the figures. This movement can take place as already described above because the projection 19 on the cantilevered arm 9 of the locking element 8 is no longer inserted into the recess 14. The bottom side of this projection can instead slide on the surface around the recess 14 in the direction of the rear part 5. This has the result that the locking element 8 can be moved into its fully latched position only when the mating plug connector 17 is correctly inserted into the plug connector housing 1 according to FIG. 13.

The recess 7 on the top side of the superstructure 4 is provided as the third complementary latch formations on the plug connector housing 1 and a movable latching nose 21 that can be moved into the recess 7 is provided on the locking element, such that the two parts together form the third complementary latch formations. The latching nose 21 approximately between the journal pin 13 and the actuating part 10 can be moved by pressure from above onto the actuating part 10 on the bottom side of the superstructure 4 until it is inserted into the recess 7. This insertion takes place only when the other latch formations have functioned and have made it possible for the mating plug connector 17 to be inserted completely and in the correct position into the plug connector housing 1, more specifically its receiving space 3. This also has the effect that the contact partners of the plug connector and the mating plug connector have been brought completely into operative connection in the correct position in order to establish the electrical connection of the connector assembly. The insertion of the latching nose 21 of the locking element 8 into the recess 7 in the superstructure 4 also has the advantage that the latching nose 21 is visible, providing a definite sign that the connector assembly has been assembled completely. Depending on the geometric design of the recess 7 and the latching nose 21 of the locking element 8, a clearly audible sound ("clicking") can also be generated. This is especially advantageous at the assembly site where the plug connector and the mating plug connector are assembled and where a high noise level prevails. Furthermore, it is important to point out that when the locking element 8 has reached its fully latched position shown in FIGS. 13 and 14, the journal pins 13 of the locking element 8 have passed by the projections 11, so that the front part of the cantilevered arm 9 is no longer being pressed down but instead lies freely in its receiving space. This advantageously ensures that the locking element 7 is disposed in a stress-free condition in its final locking position on the plug connector housing 1.

FIG. 2 shows that the recess 7 can be designed not only as a simple recess but also that the recess 7 of the superstructure 4 is formed by approximately U-shaped or rectangular frames, the ends of which are disposed on the superstructure 4 or another cross frame 22 in the recess 7. FIG. 2 shows that a frame 22 (disposed transversely in the direction of plugging) is disposed so that it is approximately half way into the recess 7 (but it may also be designed differently). Starting from this frame 22 that is designed as a cross frame, two longitudinal frames 23 on whose other end a cross frame 24 is disposed, run approximately parallel to one another. Therefore the recess for the latching nose 21 is designed to be approximately rectangular. Instead of this, the frames 23, 24 may however also be curved, i.e. designed to be approximately U-shaped that other geometries are also conceivable as long as they make it possible for a recess to be formed such that the latching nose 21 can be inserted into it and so that it provides optical feedback and/or acoustic feedback.

It is self-evident that the plug connector housing 1 shown in FIGS. 1 through 5, just like the locking element 8 as well as the mating plug connector 17 are formed as one-piece components. These one-piece components are made of plastic in a particularly advantageous manner and are produced by a plastic injection molding process in a manner that is equally advantageous.

One advantage of the geometry of the plug connector housing with the locking element inserted into it, both of which cooperate with the inserted mating plug connector, has already been mentioned but should absolutely be repeated, i.e. in its fully latched position, the locking element therefore not only produces effective locking of the plug connector and the mating plug connector but also optical and/or acoustic feedback is provided by the third latch formations during assembly to indicate whether the connector assembly has been assembled correctly and that the locking element is in stress-free contact with the plug connector housing in the fully latched position without the application of pressure from second elements of the plug connector and/or of the mating plug connector in order to avoid material fatigue during the lifetime of the connector assembly, during which the connector assembly will not usually be disconnected again.

The invention claimed is:

1. A connector assembly comprising:

a plug connector housing;

a mating plug connector that can be assembled with the housing;

a superstructure on the housing;

a locking element receivable in the superstructure and movable therein between a partially latched position and a fully latched position;

first mutually complementary latch formations on the plug connector and on the locking element that prevent movement of the locking element from the partially latched position out of the superstructure prior to insertion of the mating plug connector into the housing;

second mutually complementary latch formations on the mating plug connector and on the locking element, the second mutually complementary latch formations being actuated by insertion of the mating plug connector into the plug connector so that the locking element can be moved into its fully latched position; and third mutually complementary latch formations on the plug connector housing and on the locking element that lock together the locking element and the plug connector only when the locking element has been moved into the fully latched position.

2. The connector assembly according to claim 1, wherein the superstructure has a recess and the locking element has a latching nose that can be moved into the recess.

3. The connector assembly according to claim 1, wherein the locking element has an elongated cantilevered arm having a free end carrying an actuating part, the first locking means being in a front end region of the cantilevered arm facing away from the actuating part, the third latch formations of the locking element being on the cantilevered arm adjacent the actuating part.

4. The connector assembly according to claim 3, wherein the cantilevered arm has two journal pins at the sides between the first front latch formations and the third rear latch formations.

5. The connector assembly according to claim 1, wherein the recess is formed in the superstructure by approximately U-shaped or rectangular frames having ends on the superstructure or on a cross frame in the recess.

6. The connector assembly according to claim 1, wherein the locking element is position so that it is unstressed in its fully latched position on the plug connector housing.

* * * * *